US005910174A

United States Patent [19]

Finn

[11] Patent Number: 5,910,174

[45] Date of Patent: Jun. 8, 1999

[54] PLIERS-BASED, COMBINATION TOOL

[76] Inventor: Patrick W. Finn, 2526 Fifth Ave., North Riverside, Ill. 60546

[21] Appl. No.: 08/881,949

[22] Filed: Jun. 25, 1997

[51] Int. Cl.[6] ..... B25B 7/22

[52] U.S. Cl. ..... 7/127; 81/318; 81/438

[58] Field of Search ..... 7/127, 139, 165; 81/407, 409, 412, 416, 436, 437, 438, 439

[56] References Cited

U.S. PATENT DOCUMENTS

| | | | |
|---|---|---|---|
| 1,678,313 | 7/1928 | Atkinson | 81/318 |
| 2,022,775 | 12/1935 | Holland-letz | 81/439 |
| 4,920,593 | 5/1990 | Finn | 7/127 |
| 4,987,626 | 1/1991 | Montgomery et al. | 7/127 |
| 5,014,379 | 5/1991 | Hull et al. | 7/127 |
| 5,033,140 | 7/1991 | Chen et al. | 7/127 |
| 5,280,659 | 1/1994 | Park | 7/139 |
| 5,638,566 | 6/1997 | Wu | 81/438 |

FOREIGN PATENT DOCUMENTS

| | | | |
|---|---|---|---|
| 1064990 | 12/1953 | France | 7/127 |
| 21049 | 9/1909 | United Kingdom | 7/127 |

*Primary Examiner*—David A. Scherbel
*Assistant Examiner*—Joni B. Danganan
*Attorney, Agent, or Firm*—Mathew R. P. Perrone, Jr.

[57] ABSTRACT

A pliers-based, combination tool provides a plurality of tools for use on a pliers base and has an elongated slot in the pliers portion thereof for the purpose of locking the shanks apart, thereby permitting use of the plurality of tools.

12 Claims, 4 Drawing Sheets

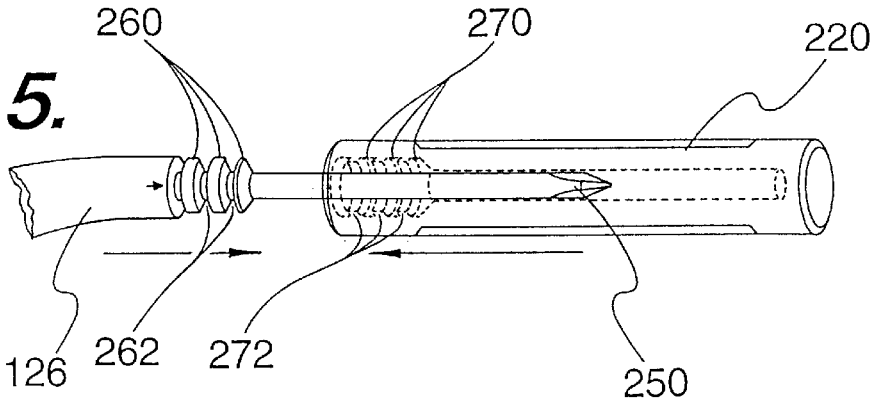
Fig.5.
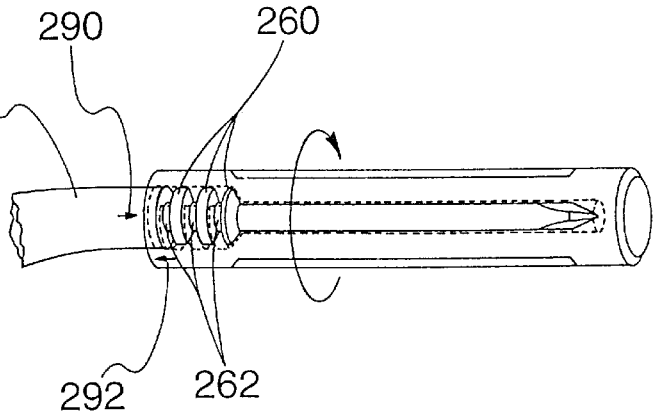
Fig.6.
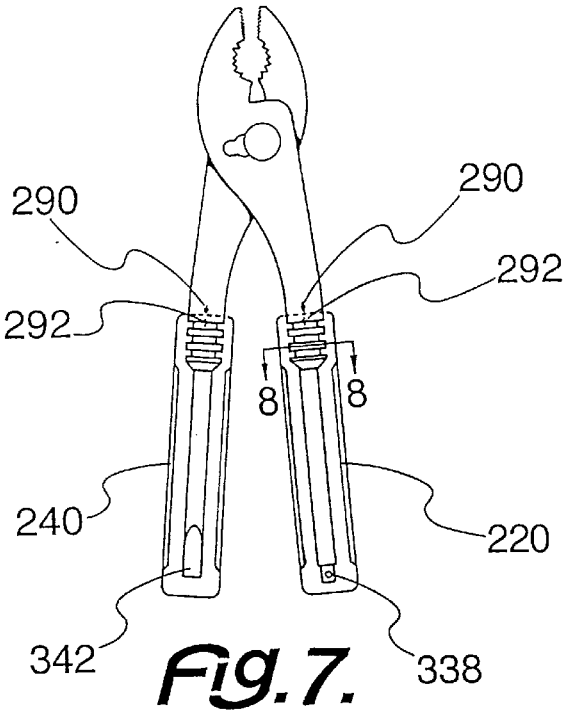
Fig.7.
Fig.8.
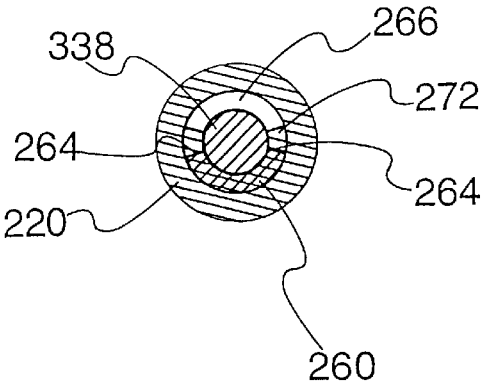

PLIERS-BASED, COMBINATION TOOL

This invention relates to a combination tool based on a pliers and more particularly to pliers-based, combination tool, which can be easily locked to use the other tool in the combination tool.

BACKGROUND OF THE INVENTION

Pliers generally have two arm elements pivotally connected at a slip joint. Each arm has a handle at one end and a jaw at the other end. The slip joint serves to expand or contract the size of the jaw opening and the resultant gripping capability of the pliers as required. Two types of pliers are typical, being commonly referred to as crescent pliers or slip pliers. Crescent pliers are also known as pliers.

It is highly desirable to provide combination tools. However, use of combination tools can result in a complicated set up which destroys the efficiency of the tool involved. Also, it is highly desirable for a compound tool to be easily used with other components and easily transferred from the use of one element of the compound tool to another element, while at the same retaining the effectiveness of the individual tool.

Furthermore, there is great difficulty in having the elements locked into position for efficient use of each element of the compound tool. If the locking cannot be accomplished efficiently, the tool lacks the required effectiveness.

The locking device of the prior art are cumbersome. There is often difficulty in operating the locking device while in the act of using the pliers as a screwdriver or other tool. Both U.S. Pat. Nos. 4,920,593; and 5,119,520, by the same inventor, address these issues and are incorporated herein by reference.

If these factors can be accomplished efficiently, the advantages of having a compound tool are equivalent to providing each tool individually while retaining the advantages of having more than one tool available immediately.

Also desirable is to have a multi-faceted pair of pliers. If the pliers tool can conserve the pliers function, while, at the same time, being modifiable in a simple fashion for other types of tools, greater advantages are obtained for the field of combination hand tools.

SUMMARY OF THE INVENTION

Therefore, among the many objectives of this invention is to provide a pliers combination tool, which is easily adapted to support the use of an additional tool.

A further objective of this invention is to provide a pliers combination tool, which is adapted in a simple manner.

A still further objective of this invention is to provide a pliers-based, combination tool adaptable to lock with one hand for using another tool.

Yet a further objective of this invention is to provide a pliers-based, combination tool adaptable with a phillips screw driver tip.

Also an objective of this invention is to provide a pliers-based, combination tool adaptable with a flat or blade screw driver tip.

Another objective of this invention is to provide a pliers-based, combination tool adaptable with a star screw driver tip.

Yet another objective of this invention is to provide a pliers-based, combination tool adaptable with an allen wrench tip.

Still another objective of this invention is to provide a pliers-based, combination tool adaptable with a scribe tip.

A further objective of this invention is to provide a pliers-based, combination tool adaptable with a square tip.

A still further objective of this invention is to provide a pliers-based, combination tool adaptable with a socket drive tip.

These and other objectives of the invention (which other objectives become clear by consideration of the specification, claims and drawings as a whole) are met by providing a pliers-based, combination tool wherein the pliers have an elongated slot for the purpose of locking the shanks apart in order to permit the other tools to be used.

BRIEF DESCRIPTION OF DRAWINGS

FIG. 5 depicts a partial cross-section view of first jaw shank 126 and first pliers shank 120 for the pliers-based, combination tool 100 of this invention with first removable sleeve 220 unlocked from first pliers shank 120.

FIG. 6 depicts a partial cross-section view of second jaw shank 156 and second pliers shank 150 for the pliers-based, combination tool 100 of this invention with second removable sleeve 240 locked on second pliers shank 150.

FIG. 7 depicts a top plan view of the pliers-based, combination tool 100 of this invention with both first removable sleeve 220 and second removable sleeve 240 locked in place.

FIG. 8 depicts an end plan cross-section view, taken along Line 8—8 in FIG. 7, of first removable sleeve 220.

Throughout the figures of the drawings, where the same part appears in more than one figure of the drawings, the same number is applied thereto.

DESCRIPTION OF THE PREFERRED EMBODIMENTS

Figure 1:
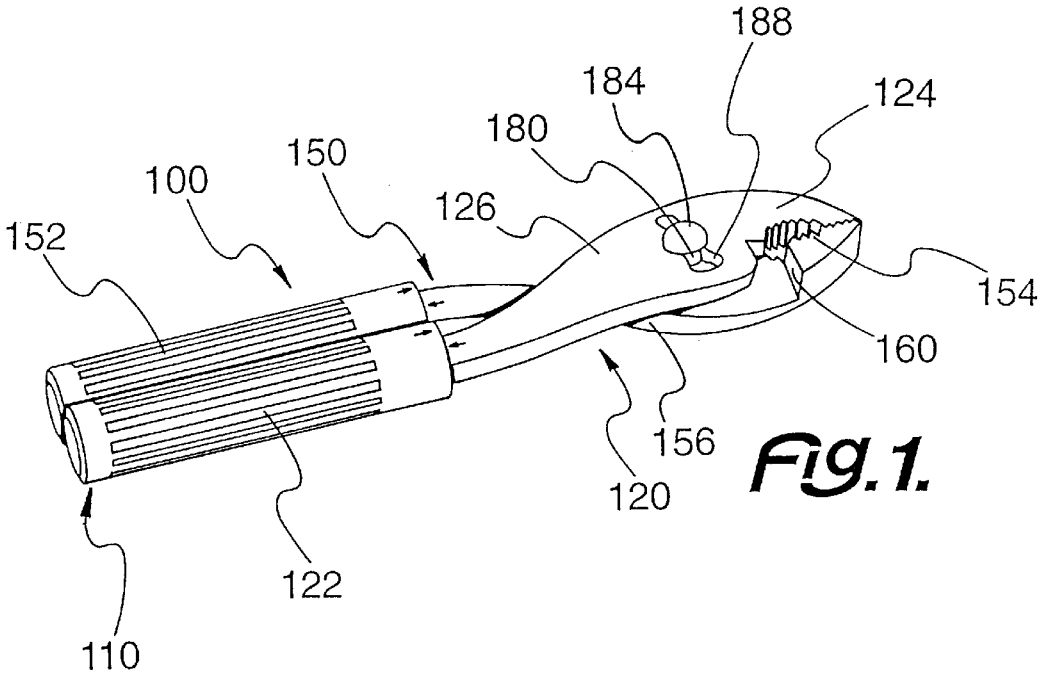
FIG. 1 depicts a perspective view of the pliers-based, combination tool 100 of this invention.

The pliers-base combination tool includes a standard pliers with a pair of jaws controlled by a pair of hand grips. A jaw shank connects the jaw to the handgrip. The first jaw is secured to the second jaw by a fulcrum bolt and a control slot. In this particular invention, the fulcrum bolt is modified to include a locking face. The jaw fulcrum is expanded to include a fulcrum cradle to receive the fulcrum bolt at the locking face. In this fashion, the handles can be removably locked in a separated manner. At the end of each pliers shank can be a tool, which makes the tool a pliers-based combination tool. With handles locked by the combination of the locking cradle and locking face, the tool at the end of each pliers shank can be used.

The pliers used as a base for the combination include a first arm and a second arm. The first arm includes a first handle or first pliers shank and a first jaw with a first jaw shank therebetween. In the first jaw shank is the expanded jaw fulcrum. The expanded jaw fulcrum includes a fulcrum cradle with a lock cradle adjacent thereto. The second arm includes a second handle or second pliers shank and a second jaw with a second jaw shank therebetween. In the second jaw shank is the fulcrum bolt aperture.

The fulcrum bolt connects first jaw shank to second jaw shank and thence first arm to second arm. The fulcrum bolt includes a head and a threaded portion oppositely disposed therefrom. Between the head and the threaded portion is the slide member. The slide member fits into the jaw fulcrum at fulcrum cradle until the head contacts the first jaw shank and is positioned thereby. Part of the slide member fits into the fulcrum bolt grip hole, in order to prevent the rotation of the bolt, while permitting the first jaw shank and the second jaw shank to move relative to each other. The threaded bolt fits into the grip hole and is held in position by the fulcrum lock nut.

The slide member permits the first jaw to rotate freely between the second jaw and the travel stop on the jaw. The slide member has a pair of opposing flattened sides. The slide rotates about the fulcrum cradle. The opposing flattened sides fit into lock cradle, thereby removably locking the handles apart for use of the additional tools. It is even possible to achieve the locking of the handles with a flip of the wrist.

The second jaw includes a travel stop to limit the amount the pliers can open. The second jaw shank also includes the aperture to receive the fulcrum bolt. The slot is in the reduced jaw fulcrum cradle and is used to achieve the desired results as the slot is open. In a travel mode, the hand grip of the pliers travel from the standard or closed position to the locked position.

On the hand grip may be removable sleeves. Within the removable sleeves may be another tool as part of the pliers shank desired for use. The removable sleeve is usually hollow on the inside and gripable on the outside. In this fashion, the removable sleeves may receive a driver tool shank. On the plier shank, is a plurality of male metal grip locks which fit into a female plastic grip lock. Also, between the male metal grip locks on the shank are female metal grip locks, which can join two male plastic grip locks within the sleeve by sliding the handle thereover.

The grip locks have a flattened side, where the grips slide over preventing the handles from losing the grips or sleeves. A rotation of the grip 90 degrees permits the various locking alignments according to the registered marks. Specifically when the registered marks are aligned the removable sleeves may be removed, providing for use of the enclosed tool. A flattened member provides an ideal place and engagement of the male plastic and male metal grip locks with the respective female members. This in turn conceals or protects whatever tool is on the handle. In a like manner the second grip registered mark and the second handle registered mark permit the second grip cover to be locked. Preferably the registered marks are in the shape of arrows with the points lining up for removal of the sleeve.

It is possible for the grip handle to be hollow and receive a plurality of tips to be used as other tools with the pliers. In this fashion, the desired head can be applied to the shank as desired. It is also possible for the pliers shank to include a hexagon head or a socket drive tip which may receive the appropriate changeable heads. Any number of tips may be used including a star tip, an allen tip, a square tip, a socket drive tip, a phillips tip, a blade tip, or a scribe tip. These may be attached to a pliers shank or attached to the socket drive or on the squared tip.

This is an additional tool for use with a pair of pliers having an additional slot at the rotation point of the pliers. A typical pliers has a figure eight rounded slot is in the center. This permits the pliers to slide from one slot to the other depending on how wide a grip is needed with the pliers. This particular pliers has an additional rectangular slot at the end of a loop of the figure eight.

Into this slot can fit the rivet holding the two pliers jaws together. The rivet is flattened on two sides to permit locking in the rectangular slot. Such locking puts the handles of the plier at right angles to each other and permits a variety of implements to be used on the pliers shanks. The implements can be a screwdriver of any style or a socket receiver. Additionally, caps can be placed over the end of the screwdriver. These caps may be screwed on or otherwise attached. A preferred attachment means is where the caps slide on and are twisted 90 degrees to provided locking slots to hold the caps in place.

Referring now to FIG. 1, the pliers-base combination tool 100 is shown in closed position 110. A first pliers shank 120 is connected to second pliers shank 150. The first pliers shank 120 is secured to the second pliers shank 150 by a fulcrum bolt 180 through an expanded jaw fulcrum 200. Expanded jaw fulcrum 200 receives fulcrum bolt 180, which has a head 184 and a threaded portion 186 oppositely disposed from the head 184.

First pliers shank 120 includes a first hand grip 122 and a first jaw 124 with a first jaw shank 126 therebetween. In the first jaw shank is the expanded jaw fulcrum 200. The second pliers shank 150 includes a second hand grip 152 and a second jaw 154 with a second jaw shank 156 therebetween. In the second jaw shank 156 is the fulcrum bolt aperture 196. On second pliers shank 150, the travel stop 160 separates the second jaw 154 from the second jaw shank 156.

Figure 2:
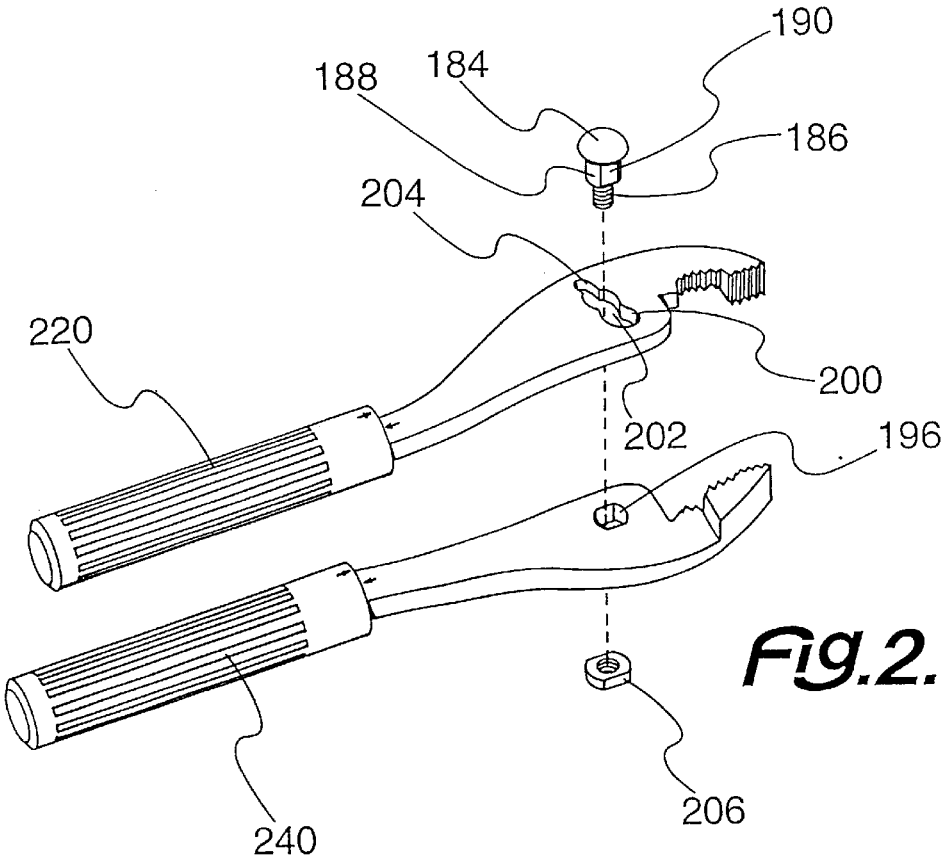
FIG. 2 depicts a depicts an exploded view of FIG. 1.

Adding FIG. 2 to the consideration, fulcrum bolt 180 has a head 184 and a threaded portion 186 oppositely disposed from the head 184. Between the head 184 and the threaded portion 186 is slide member 188. Slide member 188 has a locking face 190 including a first flat side 192 and a second flat side 194. Slide member 188 fits into jaw fulcrum 200.

Figure 3:
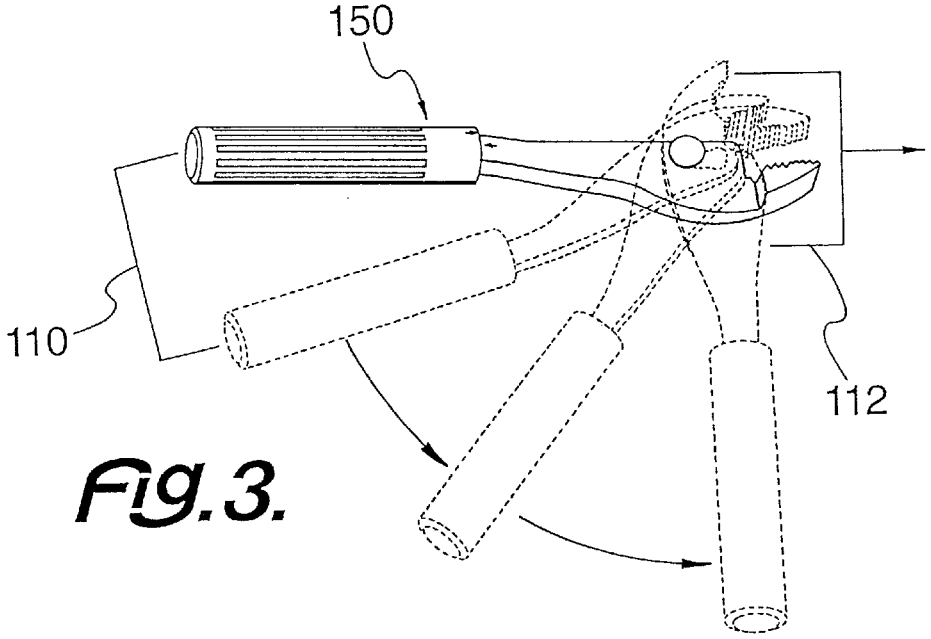
FIG. 3 depicts a perspective view of the pliers-based, combination tool 100 of this invention, executing a travel action from closed position 110 to locked position 112.
Figure 4:
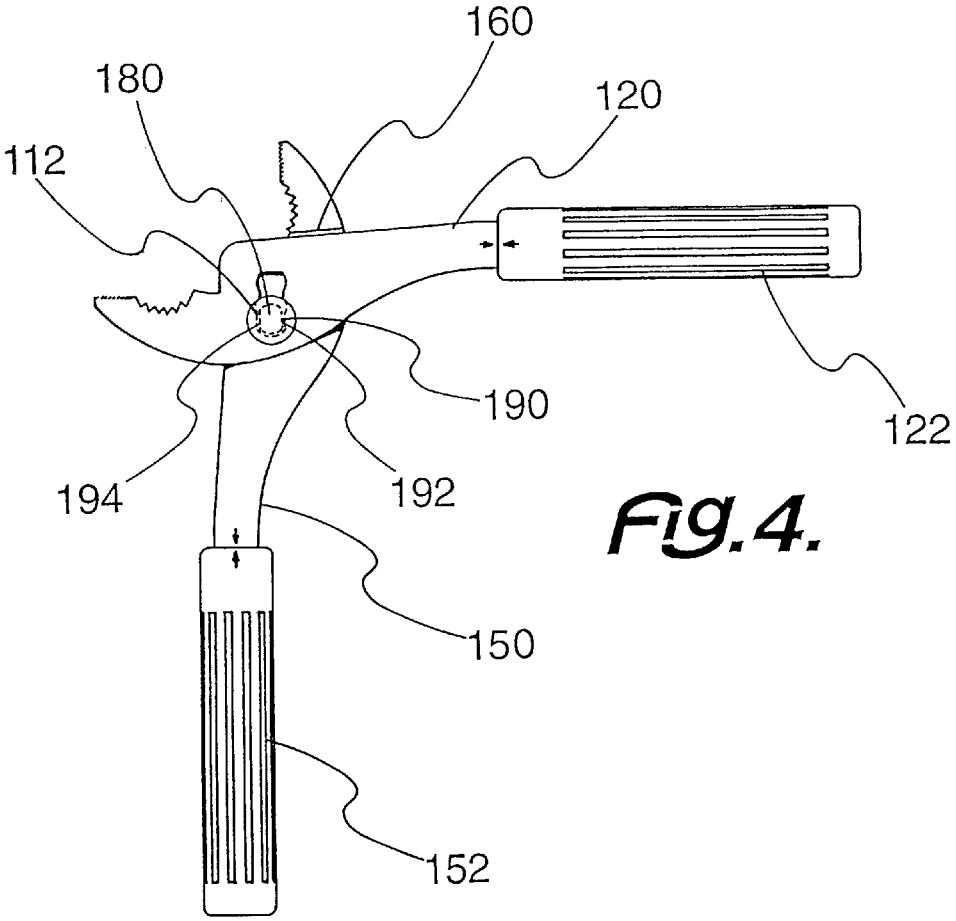
FIG. 4 depicts a top plan view of the pliers-based, combination tool 100 of this invention, in locked position 112.

Adding FIG. 3 and FIG. 4 to the discussion, the slide member 188 permits the first pliers shank 120 to rotate thereabout, then to the travel stop 160 on the second pliers shank 150. In a travel mode, the first removable sleeve 220 of the pliers travels from the standard or closed position 110 adjacent to second removable sleeve 240 to an open or locked position 112 spaced from second removable sleeve 240.

Jaw fulcrum 200 includes a fulcrum cradle 202 with locking cradle 204 adjacent thereto and communicating therewith. Locking face 190 cooperates with locking cradle 204 to position first pliers shank 120 apart from the second pliers shank 150 in open and locked position 112.

The fulcrum bolt 180 connects first jaw shank 126 to second jaw shank 156 and thence first arm to second arm. As above stated the fulcrum bolt 180 includes a head 184 and the threaded portion 186 oppositely disposed therefrom. Between the head 184 and the threaded portion 186 is the slide member 188.

The slide member 188 fits into the jaw fulcrum 200 at fulcrum cradle 202 until the head 184 contacts the first jaw shank 126 and is positioned thereby. The slide member 188 fits partially into the fulcrum bolt grip aperture 196 in second jaw shank 156. The threaded portion 186 protrudes through grip aperture 190 and held in position by the fulcrum lock nut 206.

With FIG. 5, FIG. 6, FIG. 7 and FIG. 8, on the first pliers shank 120 is first removable sleeve 220. Likewise, second pliers shank 150 has a second removable sleeve 240. Within the removable sleeves 240 and 220 may be another tool as part of the pliers shanks 120 or 150 desired for use.

First removable sleeve 220 and second removable sleeve 240 are usually similar in shape, and hollow on the inside and gripable on the outside. In this fashion, each of first hand grip 122 and second hand grip 152 may receive a driver tool shown in FIG. 5 as phillips driver 250.

On first jaw shank 126 or second jaw shank 156 are a plurality of male metal grip locks 260, which fit into a female plastic grip lock 270. The female plastic grip locks 270 are located in both of first removable sleeve 220 and second removable sleeve 240. Also, between the male metal grip locks 260 on the jaw shanks 126 and 156 are female metal grip locks 262 which can join two male plastic grip locks 272 on first removable sleeve 220 or second removable sleeve 240.

The metal grip locks 260 and 262 have a flattened side 264, where the first removable sleeve 220 or second removable sleeve 240 slide over the grips 122 and 152 and removably lock thereon. Rotation of the sleeves can then lock first removable sleeve 220 or second removable sleeve 240 on grips 122 and 152.

A rotation of the grip 90 degrees permits the various lock alignments according to the shank registered mark 290 and sleeve registered mark 292 to line up and indicate unlocked position or lack thereof. With marks 290 and 292 in alignment and unlocked position, an idle space 266 is created between first removable sleeve 220 or second removable sleeve 240, thereby permitting exposure of whatever tool is on the hand grip 122 or 152. The removable sleeves 220 and 240 protect and conceal whatever tool is on the hand grip 122 or 152.

Figure 9:
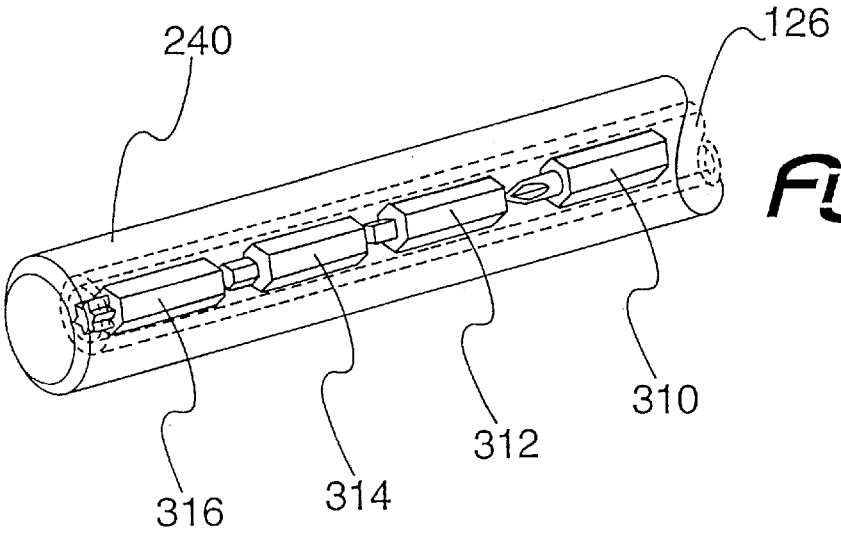
FIG. 9 depicts an end perspective, partial cross-section view of second removable sleeve 240, with a plurality of driver bits therein.

In FIG. 9, various interchangeable tips are shown for use on hand grip 122 or 152 as stored in hollow removable sleeve 220 or 240. The tips include a phillips tip 310, a square head 312, an allen head 314, and a star head 316.

Figure 10:
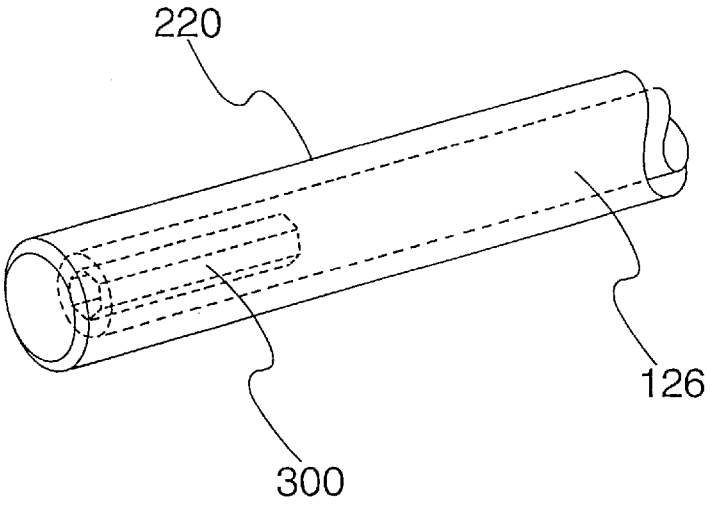
FIG. 10 depicts an end perspective, partial cross-section view of first removable sleeve 220, with a hex driver head 300 therein to receive a plurality of changeable bits.
Figure 11:
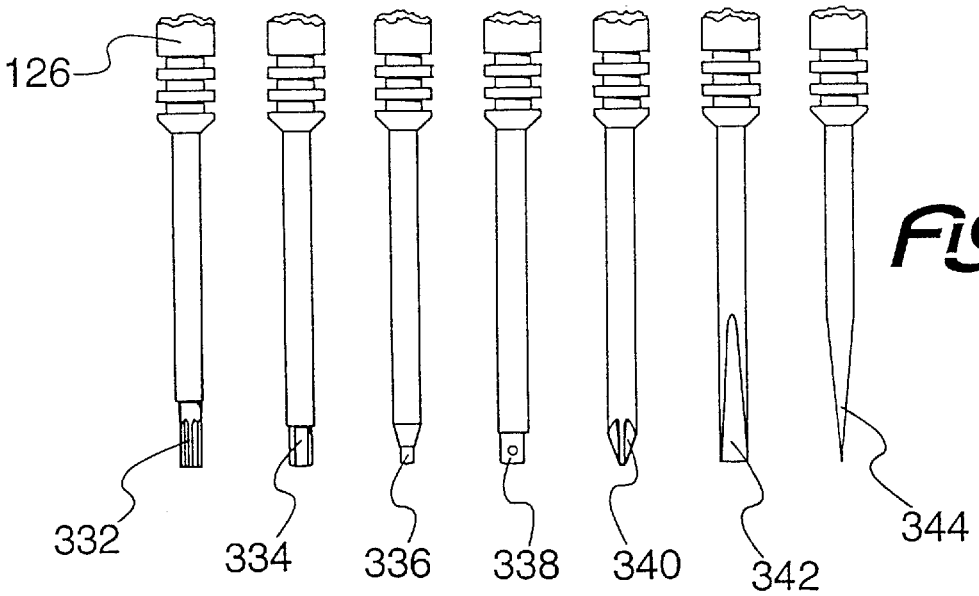
FIG. 11 depicts a plan view of second jaw shank 156 with a plurality of bits therefor.

The tips of FIG. 9 may be used with the fixed hex head 300 shown in FIG. 10. The tips may used as desired with the appropriate adaptation. With FIG. 11, fixed tips include a fixed star tip 332, a fixed allen tip 334, a fixed square tip 336, a socket drive tip 338, a fixed phillips tip 340, a fixed blade tip 342, and a fixed scribe tip 344.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this tool can become clear to a person having ordinary skill in this particular art. Such modifications are clearly covered by this disclosure.

What is claimed and sought to be protected by Letters Patent is:

1. A pliers-based, combination tool comprising:

the pliers-based, combination tool including a pliers with a first jaw and a second jaw controlled by a first handgrip and a second handgrip respectively;

a first jaw shank connecting the first jaw to the first handgrip;

a second jaw shank connecting the second jaw to the second handgrip;

the first jaw shank including a jaw fulcrum;

the second jaw shank including a fulcrum aperture adapted to cooperate with the jaw fulcrum;

a fulcrum lock bolt being adapted to join the first jaw shank to the second jaw shank;

the first handgrip having at least one tool cooperating therewith;

the fulcrum lock bolt including a locking means for holding the first jaw separated from the second jaw, in order to permit use of the at least one tool;

the fulcrum lock bolt including a head, a threaded portion oppositely disposed from the head, and a slide member situated between the threaded portion and the head;

the locking means for holding the first jaw separated from the second jaw being situated on the slide member;

the jaw fulcrum including an expanded fulcrum jaw cradle;

the expanded fulcrum jaw cradle including a reduced fulcrum cradle and a lock cradle; and the lock cradle being adapted to receive the locking means in order to permit a locked position with the first jaw and the second jaw separated;

the locking means on the slide member including a first flattened side and a second flattened side;

the first flattened side being oppositely disposed from the second flattened side;

the slide member being adapted to at least partially rotate or move within the fulcrum cradle;

the slide member being adapted to be removably received by the lock cradle in order to permit a releasably lockable position for the combination tool with the first jaw and the second jaw separated;

the expanded fulcrum jaw cradle receiving the slide member until the head of the fulcrum bolt contacts the first jaw shank;

the fulcrum aperture being adapted to at least partially receive the slide member;

a fulcrum nut being adapted to be received by the threaded portion;

a travel stop being situated between the second jaw and the second shank;

the travel stop combining with the fulcrum bolt to limit the separation between the second jaw and the first jaw;

a first removable sleeve being situated on the first handgrip;

a second removable sleeve being situated on the second handgrip;

the first removable sleeve being similar in structure to the second removable sleeve;

the first removable sleeve being cylindrical in nature with one closed end, and hollow on the inside and gripable on the outside;

the first removable sleeve being removably secured to the first handgrip;

the second removable sleeve being removably secured to the second handgrip;

the first removable sleeve being adapted to conceal the at least one tool;

the first shank and the second shank each having at least one male shank grip lock and at least one female shank grip lock;

the first removable sleeve and the second removable sleeve each having at least one male sleeve grip lock and at least one female sleeve grip lock;

the at least one male shank grip lock cooperating with the at least one female sleeve grip lock in order to provide for removing or securing a sleeve selected from the group consisting of the first removable sleeve and the second removable sleeve; and the at least one female shank grip lock cooperating with the at least one male sleeve grip lock in order to provide for removing or securing a sleeve selected from the group consisting of the first removable sleeve and the second removable sleeve.

2. The pliers-based, combination tool of claim 1 further comprising:

(a) the at least one tool being a plurality of tool heads; and (b) the tool heads being placeable and storable within the first removable sleeve.

3. The pliers-based, combination tool of claim 2 further comprising the at least one tool being selected from the group consisting of a shaped tip, a star tip, an allen tip, a square tip, a hexagon tip, a socket drive tip, a phillips tip, a blade tip, and a scribe tip.

4. The pliers-based, combination tool of claim 2 further comprising the plurality of tool heads being at least two tools selected from the group consisting of a shaped tip, a star tip, an allen tip, a square tip, a hexagon tip, a socket drive tip, a phillips tip, a blade tip, and a scribe tip.

5. The pliers-based, combination tool of claim 1 further comprising:

(a) a first member of the at least one tool being shaped as part of the first shank; and (b) a second member of the at least one tool being shaped as part of the second shank.

6. The pliers-based, combination tool of claim 5 further comprising the at least one tool being selected from the group consisting of a shaped tip, a star tip, an allen tip, a square tip, a hexagon tip, a socket drive tip, a phillips tip, a blade tip, and a scribe tip.

7. The pliers-based, combination tool of claim 1 further comprising:

(a) the first shank and the second shank having a tip selected from the group consisting of a hexagon tip and a socket tip;

(b) the tip being adapted to receive a removable tool; and (c) the removable tool being selected from the group consisting of a shaped tip, a star tip, an allen tip, a square tip, a hexagon tip, a socket drive tip, a phillips tip, a blade tip, and a scribe tip.

8. The pliers-based, combination tool of claim 1 further comprising:

(a) the at least one male shank grip lock, the at least one female shank grip lock, the at least one male sleeve grip lock, and the at least one female sleeve grip lock each having a flattened side;

(b) the flattened side being adapted to permit the first removable sleeve to lock onto or be released from the first shank; and (c) the flattened side being adapted to permit the second removable sleeve to lock onto or be released from the second shank.

9. The pliers-based, combination tool of claim 8 further comprising:

(a) a set of registered marks indicating a locking position for the first removable sleeve and the second removable sleeve;

(a) the set of registered marks including a first registered mark secured to the first removable sleeve, a second registered mark secured to the second removable sleeve, a first shank mark, and a second shank mark;

(b) the first registered mark being adapted for alignment with the first shank mark in order to indicate removability of the first removable sleeve; and (c) the second registered mark being adapted for alignment with the second shank mark in order to indicate removability of the second removable sleeve.

10. The pliers-based, combination tool of claim 9 further comprising the set of registered marks being in the shape of arrows.

11. The pliers-based, combination tool of claim 8 further comprising:

(a) the lock cradle having a generally rectangular shape; and (b) the first flattened side and the second flattened side being adapted to be received by the rectangular shape of the lock cradle.

12. A pliers-based, combination tool comprising:

(a) the pliers-based, combination tool including a pliers with a first jaw and a second jaw controlled by a first handgrip and second handgrip respectively;

(b) a first jaw shank connecting the first jaw to the first handgrip;

(c) a second jaw shank connecting the second jaw to the second handgrip;

(d) a fulcrum lock bolt, having a head and a threaded portion oppositely disposed therefrom, that fits into a fulcrum bolt grip hole and is held in position by a fulcrum lock nut;

(e) a jaw fulcrum, located on the first jaw, to receive the fulcrum bolt, which includes:

(i) a reduced fulcrum cradle;

(ii) an expanded fulcrum jaw cradle;

(iii) a lock cradle, which allows the locking of the first and second jaw together;

(f) a slide member, located between the head and the threaded portion of the fulcrum bolt, having a locking face that includes a pair of opposing flattened sides, said slide member fits into the jaw fulcrum until the head of the fulcrum bolt contacts the first jaw shank, so that the fulcrum bolt secures the first jaw to the second jaw, whereby said slide member may freely rotate about the jaw fulcrum or may fit into the lock cradle in the jaw fulcrum thereby removably locking the handles apart for use of an additional tool;

(g) the fulcrum bolt grip hole, located on the second jaw, where part of the slide member fits into, to prevent the rotation of the fulcrum bolt, while permitting the free rotation of the first jaw between the second jaw;

(h) a travel stop, located on the second jaw, that limits the amount the pliers can open, so that in a travel mode, the handgrips of the pliers travel from the standard or closed position to the locked position;

(i) a pair of removable sleeves, located on the first and second handgrips, being hollow on the inside and gripable on the outside;

(j) a plurality of tool heads, that may be placed within the removable sleeves, said tool heads having a shaped tip, a star tip, an allen tip, a square tip, a hexagon tip, a socket drive tip, a phillips tip, a blade tip, or a scribe tip;

(k) a desired tool head selected from the plurality of tool heads being applied to either the first or second shank;

(l) each shank having a plurality of male metal grip locks and female metal grip locks, which can join two male plastic grip locks within each sleeve by sliding the respective sleeve thereover;

(m) the grip locks, having a flattened side, thereby allowing the sleeve to slide over the handgrips in order to prevent the handles from losing the grips or sleeves;

(n) registered marks indicate, that when the registered marks are aligned, the removable sleeves may be removed, providing for use of the enclosed tool; and (o) a flattened side, which provides for a place and engagement of the male plastic and male metal grip locks with the respected female members that conceals or protects whatever tool is on the handle.

* * * * *